United States Patent [19]

Hyland

[11] 4,029,110

[45] June 14, 1977

[54] HAIR STYLING IMPLEMENT

[75] Inventor: Francis B. Hyland, Scituate, Mass.

[73] Assignee: The Gillette Company, Boston, Mass.

[22] Filed: June 20, 1975

[21] Appl. No.: 588,768

[52] U.S. Cl. ..... 132/33 R; 219/225; 219/222; 132/36 R; 132/9; 34/91

[51] Int. Cl.[2] ..... A45D 2/12

[58] Field of Search ..... 132/33, 34, 36; 34/91; 219/222–225, 241, 273, 274; 401/2

[56] References Cited

UNITED STATES PATENTS

| | | | |
|---|---|---|---|
| 3,721,250 | 3/1973 | Walter | 132/11 R |
| 3,730,190 | 5/1973 | Ford | 132/11 R |
| 3,768,491 | 10/1973 | Barradas | 132/37 R |
| 3,835,292 | 9/1974 | Walter | 132/37 R |
| 3,859,497 | 1/1975 | McNair | 132/37 R |
| 3,934,114 | 1/1976 | Godel | 132/33 R |

*Primary Examiner*—G.E. McNeill
*Attorney, Agent, or Firm*—Richard A. Wise; Oistein J. Bratlie; Donald E. Mahoney

[57] ABSTRACT

A vapor generating hair styling implement is arranged to style hair in contact with a cylindrical adaptor tube. The adaptor tube is detachably coupled to a handle and is in thermal contact with a heat and steam generating means. The adaptor tube may be rotated about its longitudinal axis independent of rotational movement of the heat and steam generating means.

9 Claims, 8 Drawing Figures

HAIR STYLING IMPLEMENT

BACKGROUND OF THE INVENTION

1. Field of the Invention

This invention relates to curling irons and, more particularly, to steam generating curling irons having detachable hair styling rollers.

2. Description of the Prior Art

The use of curling irons having a plurality of detachable hair styling rollers with different diameters for producing curls of different sizes in a tress of hair is well known. In the prior art, a tress of hair is wound about the surface of a tubular roller thermally coupled to an electrically heated curling iron. The heat from the roller acts upon the hair to fix a curl. The size of the curl is controlled by using rollers or adaptor tubes of different diameters. However, the rollers were attached to the curling iron so that they were not easily rotatable about their longitudinal axis. An example of an electrically heated curling iron having a plurality of detachable hair styling rollers is described in U.S. Pat. No. 3,291,141, entitled "Electrically Heated Curling Iron With Means For Making Various-Sized Curls" issued to Frank Quinio et al on Dec. 13, 1966.

Steam generating curling irons have been used to supply a metered amount of moisture for plasticizing hair wound about a heated cylindrical tube to initially form a curl. The size of the curl is determined by the diameter of the heated cylindrical tube. Heat conducted by the cylindrical tube removes the supplied moisture from the hair to fix a curl. An example of an electrically heated curling iron arranged to dispense a metered quantity of steam for curling a tress of hair is described in U.S. Pat. No. 3,835,292, entitled "Steam Curling Iron", issued to Henry J. Walter, et al, on Sept. 10, 1974.

SUMMARY OF THE INVENTION

Hair is styled by an apparatus comprising a cylindrical adaptor tube thermally coupled to heat and steam generating means. The heat and steam generating means are connected to one end of a handle. The adaptor tube means has a longitudinal axis and a plurality of apertures for discharging a vapor and hair clamping means pivotally mounted on the adaptor tube. The adaptor tube means is detachably coupled to the one end of the handle and may be rotated about the adaptor tube longitudinal axis independent of rotational movement of the heat and steam generating means.

DESCRIPTION OF THE PREFERRED EMBODIMENT

Figure 1:
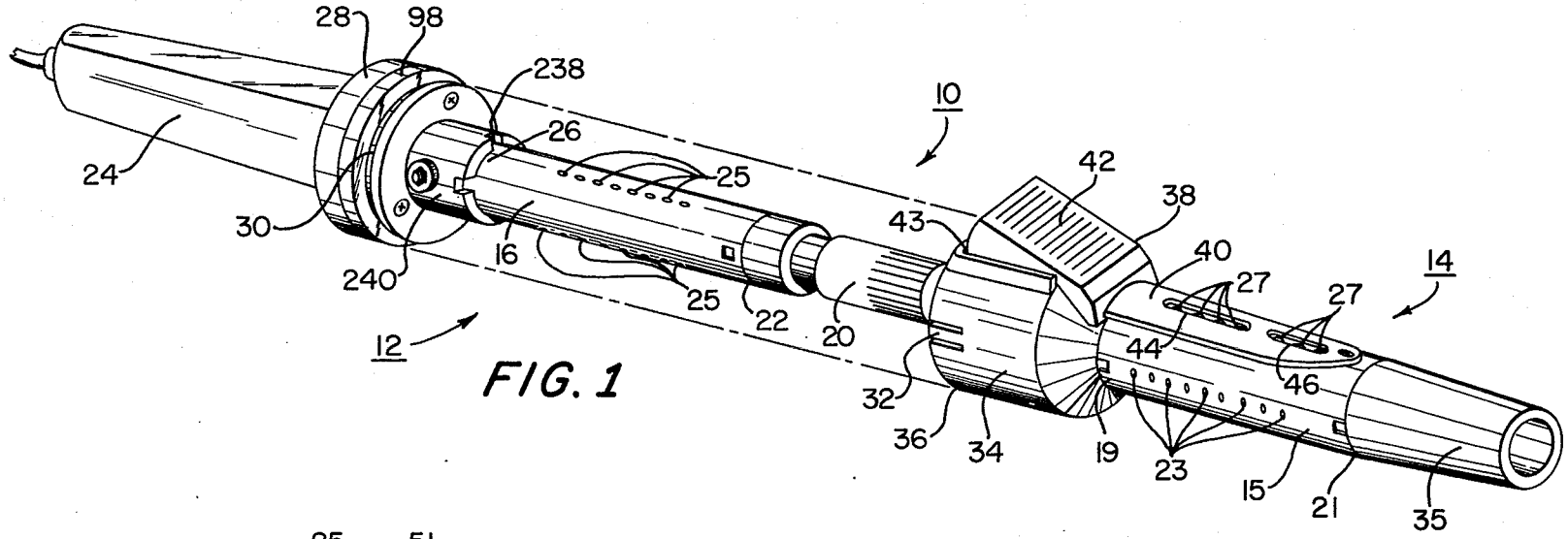
FIG. 1 is a perspective view of a hair styling implement according to the invention.

Referring to FIG. 1, there is shown a perspective view of a hair styling implement 10 comprising a heat and steam generating assembly 12 and a detachable stylng roller 14. The heat and steam generating assembly 12 includes a perforated heat conducting outer tube 16 having a fluid dispensing assembly 20 attached to an outer tube end 22 and a handle 24 attached to an outer tube end 26. The styling roller 14 includes a perforated heat conducting outer tube 15 having tubular heat insulators 34 and 35 attached to roller ends 19 and 21, respectively. The fluid dispensing assembly 20, heat insulators 34 and 35, and handle 24 are formed from heat resistant material such as polycarbonate. The perforations or apertures 23 and 27 in the styling roller outer tube 15 and the perforations or apertures 24 in the assembly outer tube 16 are suitably dimensioned for discharging steam.

Figure 7:
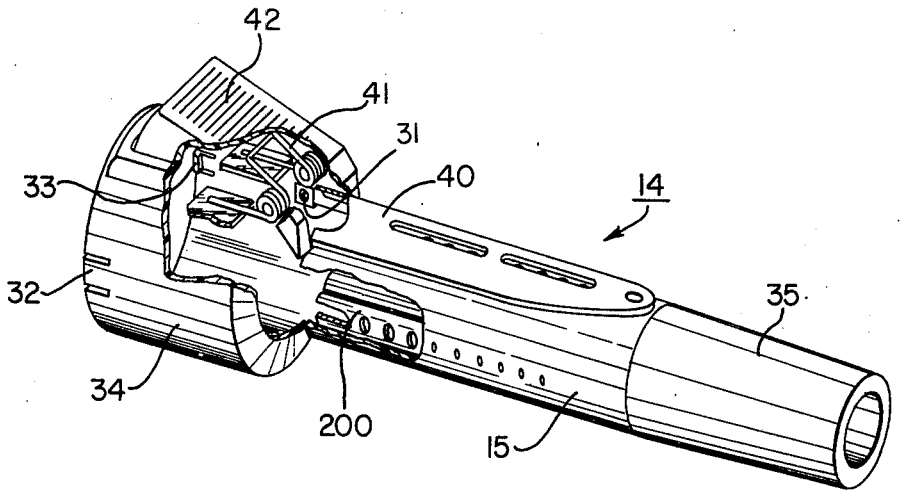
FIG. 7 is a perspective view, partially cut-away, of a rotatable styling roller, shown in FIG. 1.

The handle 24 has a tubular shaped portion 28 with an annular groove 30 therein for receiving a raised portion 33 of flexible detents 32 substantially on a margin 36 of the roller insulator 34 (FIG. 7). The styling roller 14 is thermally coupled to the assembly outer tube 16 and mechanically coupled to the handle portion 28 when the insulator 34 is forced against the handle portion 28 causing the raised portion 33 of the detents 32 to move into the groove 30. Unlike the prior art, the groove 30 and detents 32 are suitably dimensioned to permit the raised portion 33 of the detents 32 to slide within the groove 30 and the styling roller 14 to be rotatable about the longitudinal axis of the styling roller 14. A tress of hair is held against the styling roller outer tube 15 by a hair clip 38 having a heat conducting member 40 attached to a button 42 pivotally mounted on cylindrical pivot members 31 (FIG. 7) attached to insulator 34. The clip member 40 is curved and extends substantially along the length of the outer tube 15. A spring 41 (FIG. 7) normally biases the clip member 40 in a closed position against roller tube 15. The clip member 40 is pivotally moved away from the outer tube 15 when the button 42 is depressed into an opening 43 in the insulator 34 whereby the clip member 40 is raised to an open position for inserting a tress of hair between the clip member 40 and the outer tube 15. The tress of hair is clamped against the outer tube 15 by the clip member 40 when the button 42 is released and the bias provided by the spring 41 forces the clip member 40 against the tress of hair and outer tube 15. The clamped tress of hair is wrapped around the outer tube 15 and the clip member 40 by rotating the styling roller 14 about its longitudinal axis independent of any rotational movement of the heat and steam generating assembly 12. The clip member 40 has slots 44 and 46 for uncovering a plurality of roller tube apertures 27 to permit a metered amount of steam to be discharged through the apertures 27 to hair wrapped around the clip member 40 and outer tube 15. The steam plasticizes the tress of hair for initially setting a desired curl. The heat conducted to the styling roller 14 removes excess moisture from the tress of hair.

Figure 2:
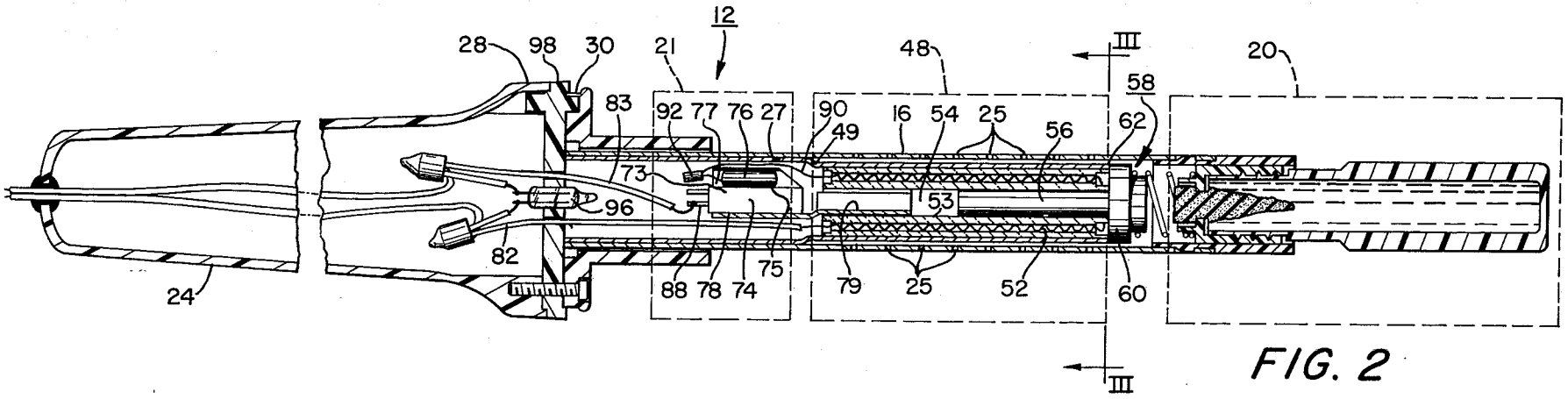
FIG. 2 is a longitudinal sectional view of a heat and steam generating assembly shown in FIG. 1.

Referring to FIG. 2, there is shown a longitudinal sectional view of the heat and steam generating assembly 12 of FIG. 1, including an electric heating assembly 48, a fluid dispensing assembly 20, a temperature control assembly 21 and a handle 24. The electric heating assembly 48 includes a heat conducting inner tube 49 disposed within the assembly outer tube 16 in frictional contact with the internal wall 27 of the outer tube 16.

Figure 3:
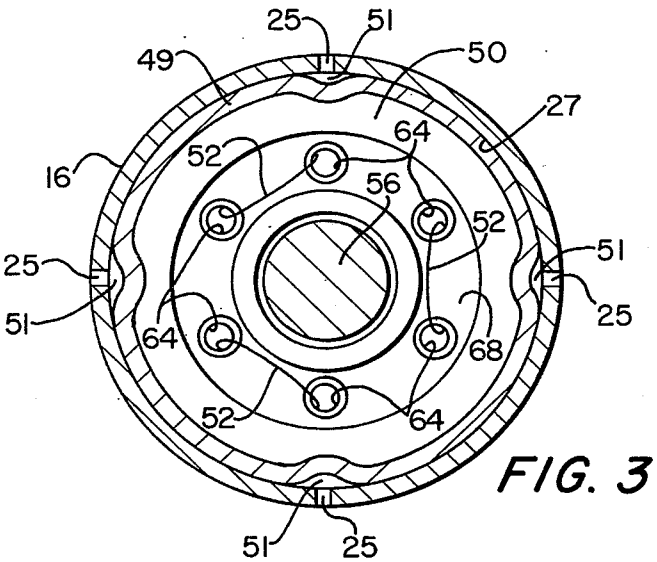
FIG. 3 is a broken cross section view of a heat and steam generating assembly shown in FIG. 1.

Referring to FIG. 3, there is shown a cross-sectional drawing of the heat and steam generating assembly 12. The inner tube 49 has a plurality of depressions 51 arranged to form voids between assembly outer tube 16 and tube 49. The voids are formed to contain a vapor before final discharge through the apertures 25. An electrical insulator 50 housing the heat generating resistance wire 52 formed from resistive material, such as nichrome, is disposed within the inner tube 49. The insulator 50 is an open-ended cylinder formed from heat conducting material, such as ceramic, with a bore 54 suitable for receiving the shank 56 of a heat reservoir or slug 58. The head 60 of heat reservoir 58 is welded, brazed, or mechanically crimped to end 62 of tube 49 (FIG. 2). Heat is generated by the conventional resistance wire 52 in response to an electrical current signal. The resistance wire 52 is disposed within a plurality of holes 64 in a circular recess 68 at each end of the insulator 50. To protect resistance wire 52 from possible short circuits and moisture, the recess 68 at each end of the insulator 50 may be sealed by a ring, not shown, of high temperature moisture resistant material, such as silicone rubber. The insulator 50 is disposed within the inner tube 49 in the proximity of the tube end 62 so that the shank 56 is received in the bore 54 to facilitate heat transfer from the resistance wire 52 to the inner tube 49 and the heat reservoir 58.

The temperature control assembly 21, shown in FIG. 2, includes a conventional thermostat 74 thermally coupled to the insulator 50 and electrically connected in series with the resistance wire 52 for regulating current conduction by the resistance wire 52. As an example, the thermostat 74 employs a temperature sensitive bimetallic element, not shown, arranged to provide a relatively low resistance current conducting path to the resistance wire 52 when the insulator 50 surface temperature is below a predetermined magnitude. The bimetallic element in the thermostat 74 disrupts current conduction to the resistance wire 52 by providing substantially an open circuit when the insulator 50 surface temperature exceeds a predetermined magnitude. If desired, a conventional thermal fuse member 76 may be serially connected between the thermostat 74 and the resistance wire 52. Fuse member 76 disrupts current conduction by the resistance wire 52 by providing substantially an open circuit in the event the thermostat 74 should fail to operate when the surface temperature of insulator 50 exceeds a predetermined magnitude.

Means for thermally coupling the thermostat 74 and the fuse member 76 to the insulator 50 include a clamp 78 formed from spring metal, such as beryllium copper. An end 79 of the clamp 78 is disposed within the insulator bore 54 and is tubular shaped to make close mechanical contact with an inner insulator surface 53. An end 77 of the clamp 78 is shaped to electrically and thermally connect the outside body 75 or first electrical terminal of the fuse member 76 to the outside body 73 or first electrical terminal of the thermostat 74. Thus, the clamp 78 transfers heat by conduction from the insulator 50 to the thermostat 74 and electrically connects the fuse member 76 in series with the thermostat 74.

Figure 4:
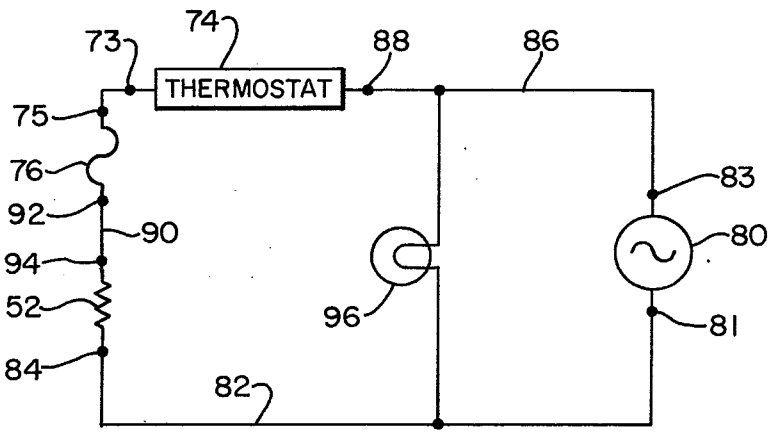
FIG. 4 is a schematic diagram of electrical wiring arranged to conduct current to heat generating resistance wire.

Referring to FIG. 4, there is shown a schematic of an electrical circuit housed in the handle 24 including the temperature control assembly 21 arranged to conduct current from a source 80 of electrical energy to the resistance wire 52. A conductive lead 82 is connected between a source terminal 81 and an end 84 of the resistance wire 52. A conductive lead 86 is connected between a source terminal 83 and thermostat terminal 88. As stated above, the thermostat terminal 73 is electrically connected to the fuse member terminal 75. A conductive lead 90 is connected between a fuse member terminal 92 and an end 94 of the resistance wire 52, whereby the thermostat 74 and fuse member 76 are electrically connected together in series with the resistance wire 52.

If desired, an incandescent lamp 96 or a neon lamp may be connected across the source terminals 81 and 83 in parallel with the resistance wire 52, fuse member 76 and the thermostat 74. The lamp 96 is energized when electrical energy is coupled to the heat and steam generating assembly 12. The energized lamp 96 is visible through a translucent cylindrical lens 98 mounted on the handle 24, as shown in FIG. 2.

Figure 5:
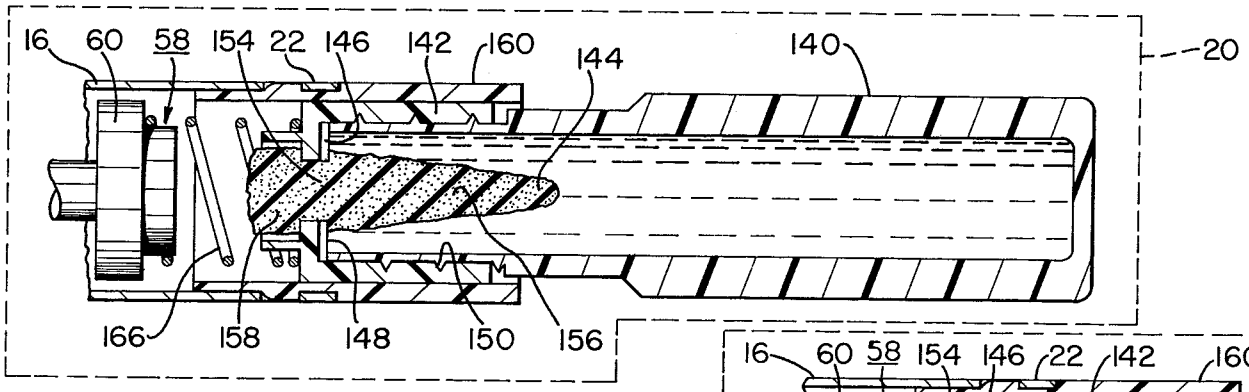
FIGS. 5 and 6 are broken sections of a fluid dispensing assembly.
Figure 6:
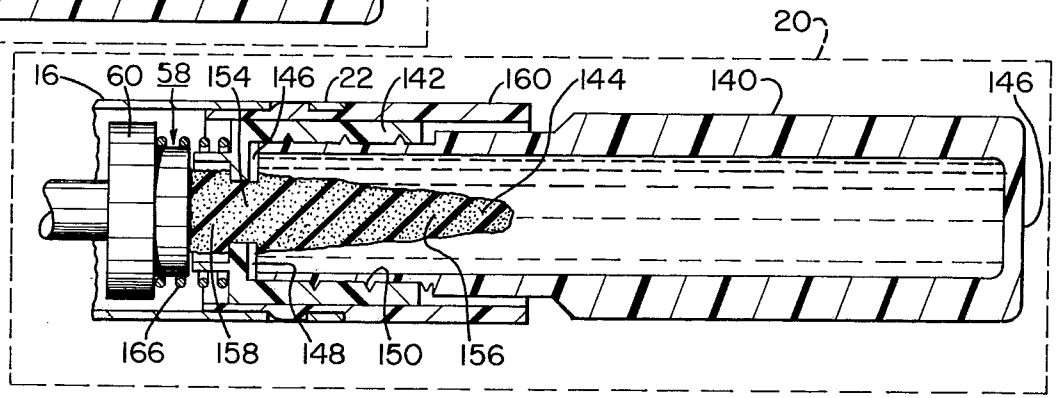

Referring to FIGS. 5 and 6, there is shown a broken section of FIG. 2, illustrating a conventional fluid dispensing assembly 20 further described in U.S. Pat. No. 3,835,292. The fluid dispensing assembly 20 includes a reservoir member 140, a reservoir end cap 142, and a wick 144. The reservoir member 140 is a hollow structure suitably formed to contain a fluid. As an example, the reservoir member 140 is tubular shaped having an externally threaded mouth 148 providing an ingress for fluid. The threaded mouth 148 of the member 140 is threadly engaged by an internally threaded portion 150 of the end cap 142. A washer 146 is internally disposed within the cap 142 to provide a seal between the reservoir member mouth 148 and the end cap 142. To avoid wetting the electrical circuit housed in the handle 24, the member 140 is filled with vaporizable fluid, such as water, and then screwed into the end cap 142 until the washer 146 provides a seal between the reservoir member mouth 148 and the end cap 142. An egress for the fluid contained in the reservoir member 140 is provided by the wick 144 inserted in an aperture 154 in the end cap 142 so that a wick portion 156 extends inside the cap 142 and the member 140 and a wick portion 158 is external to the end cap 142. The wick portion 156 acts like a sponge to absorb fluid contained within the reservoir member 140 and transfers the absorbed fluid by capillary action to the external wick portion 158.

The fluid dispensing assembly 20 is suitably attached to the outer tube end 22 so that the wick portion 158 may be forced against the heated heat reservoir 58 to generate steam. For example, the fluid dispensing assembly 20 is partially disposed within a tube-like sleeve 160 force fitted into the assembly outer tube end 22. The sleeve 160 is suitably arranged to hold the end cap 142 and the wick portion 158 opposite the heat reservoir 58 in substantially coaxial alignment with the assembly outer tube 16. The bore of sleeve 160 is of sufficient diameter to permit a sliding movement of the fluid dispensing assembly 20 toward the heat reservoir head 60. A spring member 166 is inserted between the heat reservoir head 60 and the end cap 142 to bias the wick portion 158 away from the heat reservoir head 60. As shown in FIG. 6, a suitable force applied to a reservoir end 146 compresses the spring member 166 and moves the fluid saturated wick portion 158 against the heat reservoir head 60 to generate a predetermined amount of vapor. The vapor is contained within the void 51 between the heat conducting tube 49 and the assembly outer tube 16 and then discharged through the apertures 25 in the outer tube 16.

Referring to FIG. 7, there is shown a perspective view, partially cut-away, of the styling roller 14 of FIG. 1. The styling roller 14 is arranged so that heat may be transferred from the assembly outer tube 16 to the roller outer tube 15. For example, means for transferring heat from the assembly outer tube 16 to roller tube 15 include a perforated roller inner tube 200 disposed within roller outer tube 15. The roller inner tube 200 is formed from heat conducting material, such as aluminum, in the shape of an open-ended grooved cylinder having a suitable diameter permitting tube 200 to slide over the assembly outer tube 16 and rotate about the longitudinal axis of the assembly outer tube 16. The diameter of tube 200 is selected to provide a desired amount of heat transfer, substantially by radiation, from the assembly outer tube 16 to the tube 200. Heat may also be transferred by conduction from the assembly outer tube 16 to the tube 200 if sufficient friction contact is provided between the tubes 16 and 200.

Figure 8:
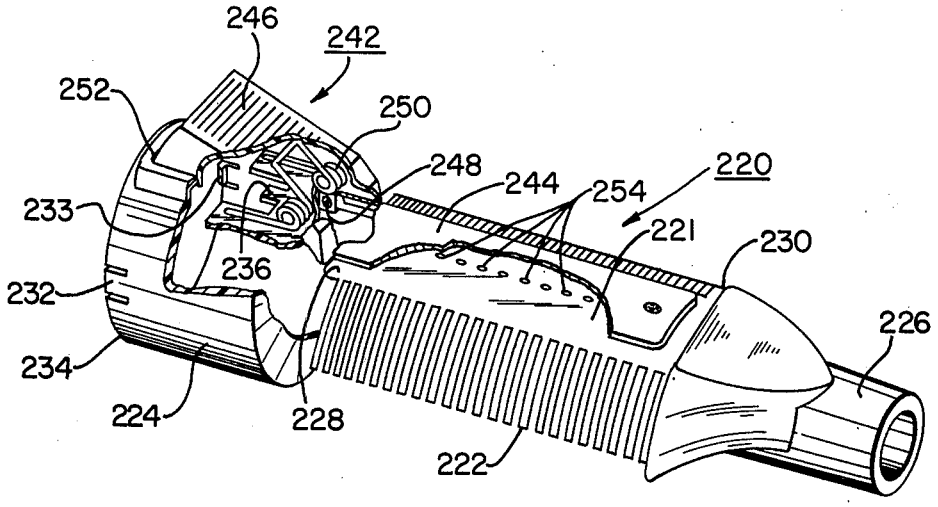
FIG. 8 is a perspective view, partially cut-away, of a non-rotatable styling roller having comb-like appendages.

Referring to FIG. 8, there is shown a perspective view, partially cut-away, of a detachable non-rotatable styling roller 220 having a perforated heat conducting tube 221 and attached comb-like appendages 222. The outside diameter of the tube 221 may be different from the outside diameter of the tube 15 of the roller 14 for imparting a different-size curl. The appendages 222 are formed transverse to the longitudinal axis of tube 221 for arranging a tress of hair in a preferred hair styling.

Tubular heat insulators 224 and 226 are attached to roller ends 228 and 230, respectively. Flexible detents 232 having raised portions 233 are formed on the margin 234 of the roller insulator 224. The roller 220 is thermally coupled to the assembly outer tube 16 when the insulator 224 is forced against handle portion 28 and the raised portions 233 on the detents 232 are moved into the groove 30 in the handle 24. Rotational movement of roller 220 about the longitudinal axis of tube 14 is prevented by arranging insulator 224 to have a key 236 which may be inserted into a keyway 238 on handle portion 240 (FIG. 1).

A tress of hair is held against the roller 220 by a hair clip 244 having a heat conducting member 244 attached to a button 246 pivotally mounted on cylindrical pivot members 248 attached to insulator 224. The clip member 244 is arranged to be normally biased in a closed position against the roller tube 221 by a spring 250. The button 246 is depressed into an opening 252 in the insulator 224 to pivotally move the clip member 244 away from the roller tube 221, whereby the clip member 244 is in an open position for inserting a tress of hair between the member 244 and the roller tube 221. The tress of hair is clamped against the roller tube 221 by the clip member 244 when the button 246 is released and the bias provided by the spring 250 forces the clip member 244 against the tress of hair and the roller tube 221.

The styling roller 220 is arranged so that its opening surface temperature is substantially equal to the operating surface temperature of the styling roller 14. For example, the inside diameter of the tube 221 is selected to permit the tube 221 to slide over the assembly outer tube 16 and provide a desired amount of heat transfer by radiation and conduction from the assembly outer tube 16 to the tube 221. The tube 221 has apertures 254 through which steam from the heat and steam generating assembly 12 is discharged. As an example, the apertures 254 may be located beneath the clip member 244 so that a tress of hair held against roller tube 221 may be plasticized by the vapor generated by the heat and steam generating assembly 12.

A hair styling implement 10 has been described above in connection with a specific embodiment having a detachable styling roller 14 thermally coupled to a heat and steam generating assembly 12 for imparting a desired curl to a tress of hair. It should be appreciated that the described embodiment of a rotatable styling roller having a fixed diameter is only by way of example. Various styling rollers, rotatable and nonrotatable, having different diameters for imparting different curls to a tress of hair may be used to implement the described principle. Thus, many other arrangements can readily be devised in accordance with the described principles by those skilled in the art.

What is claimed as new and desired to be secured by Letters Patent of the United States is:

1. Hair styling apparatus comprising:
heat and steam generating means;
a handle having one end connected to said heat and steam generating means;
a cylindrical adaptor tube means having a plurality of apertures for discharging a vapor;
hair clamping means pivotally mounted on said adaptor tube for clamping a tress of hair against said adaptor tube; and
means for detachably coupling said adaptor tube and hair clamping means to said one end of said handle, said adaptor tube and hair clamping means being in thermal contact with said heat and steam generating means and rotatable about a longitudinal axis of said adaptor tube independent of rotational movement of said heat and steam generating means.

2. Hair styling apparatus according to claim 1, wherein:
said heat and steam generating means comprises a first tubular member having a plurality of apertures and a first end connected to said one end of said handle;
a second tubular member disposed within said first tubular member in friction contact with said first tubular member, said second tubular member having a depression forming a void between said first and second tubular members;
heat reservoir means attached to one end of said second tubular member;
heat generating means disposed within said second tubular member in heat transfer contact with said heat reservoir means and said second tubular member; and
fluid dispensing means mounted on a second end of said first tubular member for supplying a predetermined amount of fluid to said heat reservoir means for vaporization, whereby said vaporized fluid is discharged through said apertures.

3. Hair styling apparatus according to claim 1, wherein said means for detachably coupling said adaptor tube to said handle includes a circumferential groove in said handle and a flexible detent on said adaptor tube for cooperating with said groove to fasten said adaptor tube to said handle, whereby said adaptor tube is rotatable about said longitudinal axis of said adaptor longitudinal axis longitudinal axis independent of rotational movement of said heat and steam generating means.

4. Hair styling apparatus according to claim 2, wherein said heat generating means include resistance wire responsive to electrical current.

5. Hair styling apparatus according to claim 4, wherein said resistance wire is embedded in a heat conduction electrical insulator disposed with said second tubular member.

6. Hair styling apparatus according to claim 2, wherein said fluid dispensing means include a fluid saturated wick and a means for moving said fluid saturated wick to contact said heat reservoir means for vaporizing said fluid in said wick.

7. Hair styling apparatus comprising:

heat and steam generating means;

a handle having one end connected to said heat and steam generating means;

a cyclindrical adaptor tube means having a plurality of apertures for discharging a vapor;

hair clamping means pivotally mounted on said adaptor tube for clamping a tress of hair against said adaptor tube; and means for detachably coupling said adaptor tube and said hair clamping means to said handle including a circumferential groove in said handle and a flexible detent on said adaptor tube for cooperating with said groove to fasten said adaptor tube to said handle, said adaptor tube being substantially in coaxial alignment with said heat and steam generating means and in thermal contact with said heat and steam generating means.

8. Hair styling apparatus according to claim 7, wherein said heat and steam generating means comprises a first tubular member having a plurality of apertures, and a first end connected to said one end of said handle;

a second tubular member disposed within said first tubular member in friction contact with said first tubular member;

heat generating means disposed within said second tubular member; and fluid dispensing means mounted on a second end of said first tubular member for supplying a predetermined amount of fluid to said second tubular member for vaporization, whereby said vaporized fluid is discharged through said apertures.

9. Hair styling apparatus according to claim 7, wherein said cylindrical adaptor tube means have comb-like appendages extending from a peripheral surface of said adaptor tube.

* * * * *

UNITED STATES PATENT OFFICE

CERTIFICATE OF CORRECTION

PATENT NO. : 4,029,110

DATED : June 14, 1977

INVENTOR(S) : FRANCIS B. HYLAND

It is certified that error appears in the above-identified patent and that said Letters Patent are hereby corrected as shown below:

Column 6, line 66, after "adaptor" delete -- longitudinal axis longitudinal axis independent --

Column 6, line 67, before "of" first occurrence insert -- tube independent --

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*